United States Patent [19]

von Knorre et al.

[11] 4,360,806

[45] Nov. 23, 1982

[54] DISPLAY FOR WORD PROCESSOR PRESENTING MARGIN ZONE MARKERS

[75] Inventors: Karl-Friedrich von Knorre, Varel; Peter Tillich; Gottfried Herbermann, both of Wilhelmshaven, all of Fed. Rep. of Germany

[73] Assignee: Olympia Werke AG, Wilhelmshaven, Fed. Rep. of Germany

[21] Appl. No.: 137,473

[22] Filed: Apr. 4, 1980

[30] Foreign Application Priority Data

Apr. 5, 1979 [DE] Fed. Rep. of Germany ..... 2913624

[51] Int. Cl.[3] ..... G09G 3/20

[52] U.S. Cl. ..... 340/792; 340/706; 340/711; 400/83

[58] Field of Search ..... 340/709, 723, 735, 706, 340/792; 178/15, 30; 400/83, 84, 85, 15

[56] References Cited

U.S. PATENT DOCUMENTS

| | | | |
|---|---|---|---|
| 3,526,887 | 9/1970 | Erni | 340/753 |
| 3,582,946 | 6/1971 | Mita et al. | 340/792 |
| 3,618,032 | 11/1971 | Goldsberry et al. | 340/706 |
| 3,816,823 | 6/1974 | Manber | 340/723 |
| 3,939,458 | 2/1976 | Kuntze | 340/723 |
| 4,039,746 | 8/1977 | Talbot | 178/15 |
| 4,193,071 | 3/1980 | Hasegawa et al. | 340/723 |

FOREIGN PATENT DOCUMENTS

| | | | |
|---|---|---|---|
| 17739 | 10/1980 | European Pat. Off. | 400/83 |
| 2742992 | 3/1978 | Fed. Rep. of Germany . | |
| 2801750 | 7/1978 | Fed. Rep. of Germany . | |
| 2806121 | 7/1979 | Fed. Rep. of Germany | 400/83 |

OTHER PUBLICATIONS

*Journal Lumineux avec un 8080*, Lilen, 11/77, Electronique and Applications Industrielles 243, pp. 23–25.

*Primary Examiner*—Marshall M. Curtis
*Attorney, Agent, or Firm*—Spencer & Kaye

[57] ABSTRACT

In a display device in a character processing machine, which machine operates to provide text in the form of successive lines of characters, with the length of each such line being within a predetermined range defined by a margin zone at the right-hand end of each line, the machine including an input keyboard for the input of character representations and a data memory connected for storing such representations, and the display device being connected to receive such representations from the memory and to display at least the end portion of a line of characters, with each character appearing, in the order of its input to the keyboard, at an entry location of the display and then shifting to the left in the display upon delivery of each subsequent character to the display, the display device is arranged to present a plurality of character display locations equal in number, and corresponding in position, to the spaces of the margin zone at the end of each line of characters, and the machine is constructed for causing margin zone markers to be displayed in the display device at the character display locations.

11 Claims, 3 Drawing Figures

DISPLAY FOR WORD PROCESSOR PRESENTING MARGIN ZONE MARKERS

BACKGROUND OF THE INVENTION

The present invention relates to a display device for displaying lines of text in a character, i.e. word and/or data, processing machine.

German Offenlegungsschrift [Laid-open Application] No. 2,801,750 describes a word processing machine provided with an optical display device on which one complete line of text can be displayed. The operator of such a machine has an opportunity to predetermine the position of the right-hand margin as well as the width of a margin zone which are then displayed on the display device by way of markers. The margin zone is constituted by a selected number of character spaces and the right-hand end of a line of characters within which the line is to terminate as dictated by the line length requirements imposed by the selected text format. When text is put in through the keyboard of the machine, the alphanumeric characters thereof appear on the display device in succession from the left to the right in the sequence in which they were fed in until the marked margin zone is reached. The operator now is able to visually control at which point in the text within the margin zone he wants to initiate a line shift, if necessary after first breaking up a word.

In this known machine the display device must have such a width that a complete line can be displayed because only then can a margin zone be optically marked in advance to then be reached with successive inputs of text. Since, however, the characters on the display device must have a size which makes them satisfactorily legible for the operator, a size which goes considerably beyond the size of the character which will be printed on the record carrier, a display device for a complete line length is too wide to be accommodated in the housing of a conventional office machine. Additionally, the costs for such a multi-position display with associated corresponding multi-position actuating circuits are unjustifiably high for the price level of conventional word processing machines.

In another known word processing machine, described in German Offenlegungsschrift No. 2,742,992, there is therefore provided a display device for displaying part of a line, i.e. always the last 15 characters fed in. The characters which are fed in by means of a keyboard or from a text memory are here displayed on the right-hand side of the display device and, with every input of a new character, are shifted to the left by one position so that in the extreme right-hand position of the text display area of the display device there always appears the character which was fed in last. The operator can preset the desired line length, and a consecutive number display, in a separate area of the display device informs him of the number of spaces in the line already occupied as a result of the actuation of keys. Moreover, the operator has an opportunity to predetermined a margin zone within which he is audibly warned if a space or a hyphen occurs.

With this word processing device there is no expensive and cumbersome whole line display. But since a character display which shifts from the right to the left makes it impossible to optically display, in advance, attainment and, particularly, the width of a margin zone, it is very complicated for the operator to control the right margin. In all cases where there is no hyphen or space in the margin zone, the operator must determine the degree of occupation of the line via the position counter and must calculate the positions, or spaces, in which he has an opportunity to separate a word. The same applies of course for cases in which a line shift is to be made, for example for reasons inherent in the text, not at a hyphen or space accidentally appearing in the margin zone.

SUMMARY OF THE INVENTION

It is an object of the present invention to provide a display device which enables the operator to effect a simple, direct optical control regarding the approach to and utilization of a margin zone, without requiring display of an entire line.

This and other objects are achieved, according to the invention in a display device in a character processing machine, which machine operates to provide text in the form of successive lines of characters, with the length of each such line being within a predetermined range defined by a margin zone at the right-hand end of each line, the machine including an input keyboard for the input of character representations and a data memory connected for storing such representations, and the display device being connected to receive such representations from the memory and to display at least the end portion of a line of characters, with each character appearing, in the order of its input to the keyboard, at an entry location of the display and then shifting to the left in the display upon delivery of each subsequent character to the display, by arranging the display device to present a plurality of character display locations equal in number, and corresponding in position, to the spaces of the margin zone at the end of each line of characters, and by providing the machine with means connected for causing margin zone markers to be displayed in the display device at the character display locations.

The advantages offered by the present invention include, in particular, that the operator, when putting in text, has the beginning and size of the margin zone before his eyes in plenty of time and, when reaching the margin zone, is free to decide at which point in the text that falls into the margin zone he will actuate a line shift. The effective optical display then eliminates the need for any calculation of the positions remaining to the end of the line.

According to an advantageous embodiment of the invention, when texts are read out of the memory of the word processing device for the purpose of checking or editing the read-out text, the operator has a simple aid for evaluating the margin zone occupation in each line again by the markers for the margin zone displayed on the display device.

DESCRIPTION OF THE PREFERRED EMBODIMENTS

Figure 1:
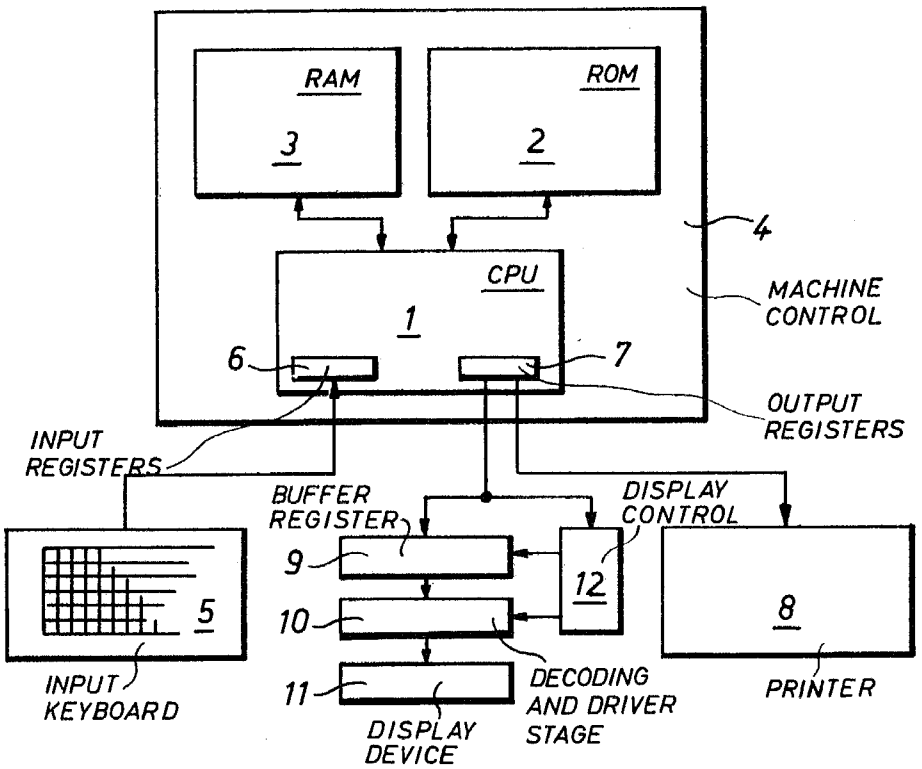
FIG. 1 is a block circuit diagram for a word processing machine of the type employed in the practice of the invention.

FIG. 1 shows a word processor with its components which are essential to the understanding of the present invention. This includes a microprogram controlled machine control 4 which includes a central calculating and control unit (CPU) 1, a microprogram memory (ROM) 2, and a data memory (RAM) 3. Data fed in via a keyboard 5 and input registers 6 are processed in a known manner and data to be read out are transmitted via output registers 7 to a printing mechanism 8 to be displayed on a record carrier.

Additionally, data can be transmitted via the output registers 7 to a buffer register 9 where they are stored and from where they reach a decoding and driver stage 10. In the decoding and driver stage 10, the coded data are converted to actuating signals for a display device 11 and fed to this display device 11 under the control of a display control 12 which determines the sequence and frequency of transfer from the buffer register 9 to the decoding and driver stage 10 and actuation of the display device 11. This actuation function could of course also be performed directly by the machine control 4; it has been found advisable, however, to keep the machine control 4 available for the actual task of word processing and to provide a separate display control for the display of the alphanumeric characters.

In a known manner, a text which has been fed in by an operator via the keyboard 5 is read into the data memory 3 under control of the central calculating and control unit 1 and the microprogram memory 2. At the same time, the portion of the text which has been fed in last is displayed on the display device 11 so that the operator has available a visual control of the accuracy of his input.

If the operator notices an error in the displayed text, he has an opportunity, by operating the appropriate input means on keyboard 5, e.g. a backing key, to set the address of the data locations in the data memory 3 (address indicator) to the location where he wants to make a correction. Inputting of a new character then causes it to be stored at that location in the data memory 3 and to be displayed on the display device 11 instead of the original character.

A text fed in and possibly corrected in such a manner can then be printed out with a time delay on a record carrier by means of the printing mechanism 8, the start of printing of each line being actuated, for example, by actuation of a line shift when all of that line has been put in.

Of course, other modes of operation may be provided for selection by the operator when required. This includes, for example, input into the data memory 3 with simultaneous display of the data on the display device 11 but without printout of the text; input of a text with display on the display device 11 and simultaneous printout by means of the printing mechanism; display of a text stored in the data memory 3 without printout on the printer 8 or with printout. The operator is thus afforded a great variety of possible processing modes.

Figure 2:
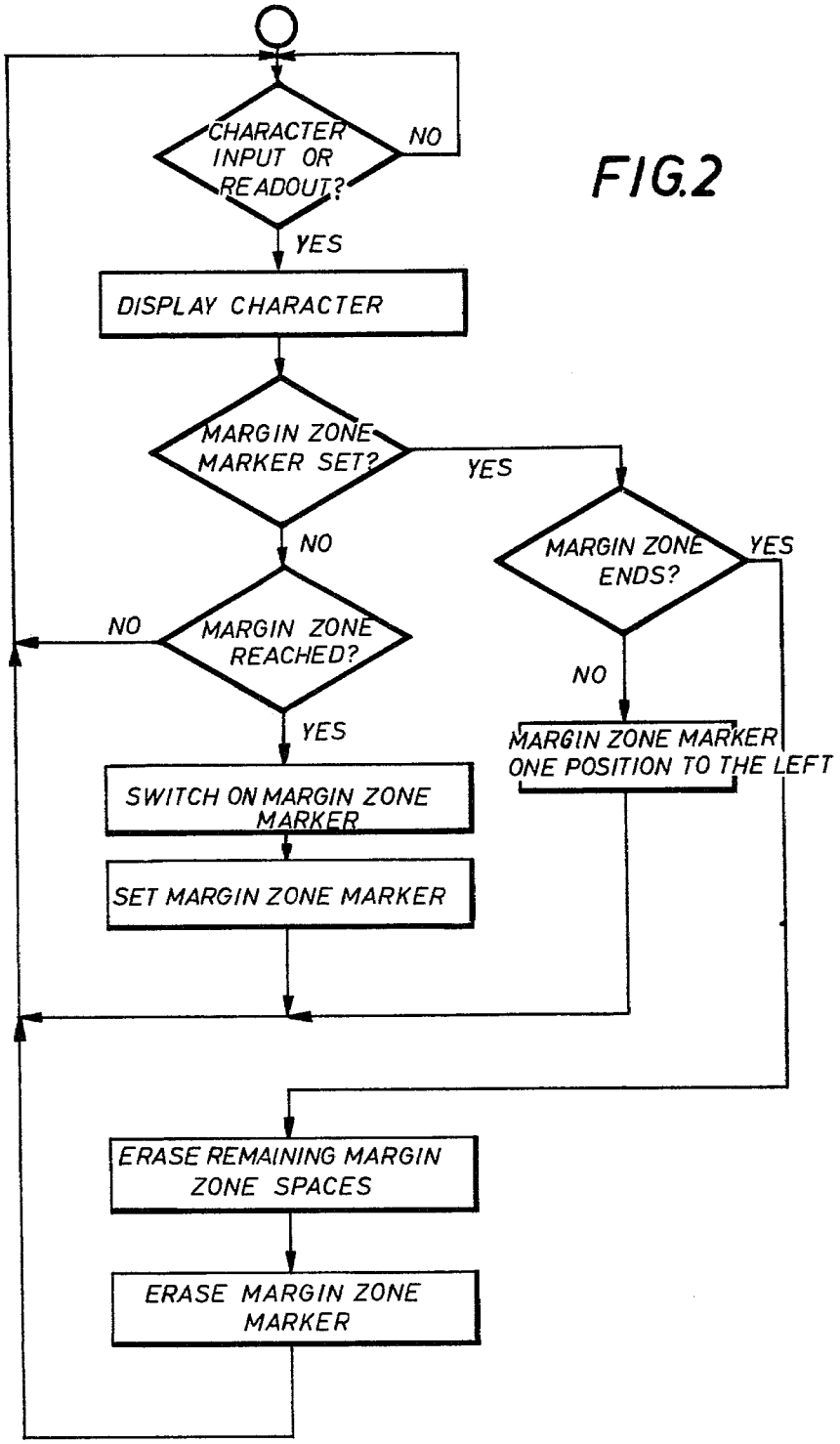
FIG. 2 is a simplified programming flow diagram illustrating the operation of a preferred embodiment of the invention.

The display of the text and the display of the margin zone at the end of each line will now be explained with reference to FIGS. 2 and 3. The words "eine Zeichenanzeige" are to be put in and displayed on the display device, each individual character, i.e. letter, appearing on the display device, as it is being put in, at the location shown by the arrow 13 in FIGS. 3*a* through 3*c*. When the next character is put in, the previous character is shifted toward the left by one space, or position. After each character input, an interrogation takes place within the machine control to determine whether a margin zone marker has been set in the corresponding register of the control 4 to indicate that the input is now taking place within the margin zone. If this is not the case, a further interrogation takes place to determine whether or not the margin zone was reached with the last input.

Figure 3A:
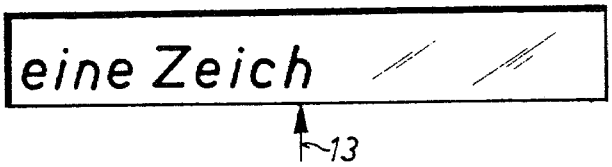
FIGS. 3*a* to 3*e* are pictorial views of a display device in various states of operation according to the invention.
Figure 3B:
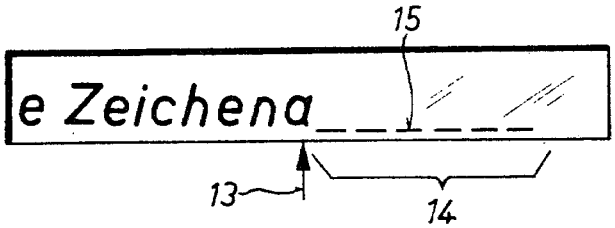

At the moment shown in FIG. 3*a*, the letters of the text "eine Zeich" have been put in in succession, the respective interrogations for "Margin zone marker set?+ and "Margin zone reached?" having produced a negative result each time. After the input of three further characters, at the moment shown in FIG. 3*b*, the question "Margin zone reached?" yields a positive answer. The result is that to the right of the input location 13, the number of positions for the margin zone 14 as preset by the operator is displayed by markers 15 underneath the character display area. At the same time the margin zone marker is set which fixes the beginning of the margin zone 14 internally in the control mechanism; and the operator's attention is called to the fact that the margin zone 14 has been reached, for example by means of an audible signal. With the aid of the optically displayed remaining spaces available for the line, the operator can now predetermine the desired point of word separation.

Figure 3C:
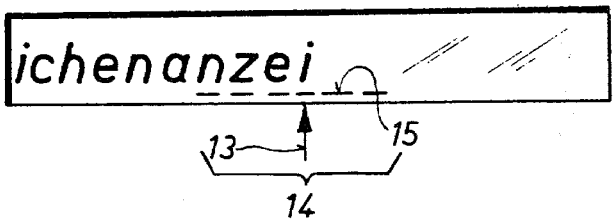
Figure 3D:
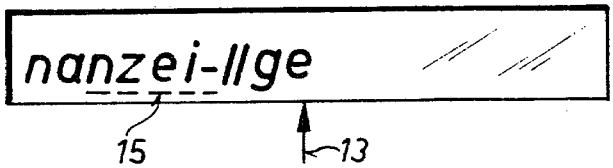

At the moment shown in FIG. 3*c*, the operator has put in four more characters filling four of the positions of the margin zone 14 which, in this example, consists of six character positions. During the input of each one of these characters: n-z-e-i, the question "Margin zone marker set?" will have produced a positive answer followed by a further question "Margin zone ends?". Since in the example of FIG. 3*c* the margin zone 14 still has two unoccupied positions and no line shift has been initiated, the latter question up to now has received a negative answer and the margin zone markers 15 have been shifted, together with the text, to the left by one position each time so that the characters falling into the margin zone 14 have been identified as such.

At this point in the operation, the operator feeds in a separating character, i.e. a hyphen, actuates the line shift and carriage return key and continues typing in the new line. The display device then presents the display shown in FIG. 3*d* in which two vertical parallel lines identify the beginning of a new line and the marker(s) 15 to the right of the separating character are deleted.

According to another conceivable embodiment the feeding in of a separating character or of a space designation can be made to automatically actuate a line shift and to cause further input to begin at the start of a new line.

The performance of a line shift with carriage return has the result in any case that with the next character the question "Margin zone ends?" receives a positive answer. The display of any remaining spaces in the margin zone of the preceding line is then erased, as is the margin zone marker and the text input in the new line takes place as described above. The display shows that five characters of the line just completed lie in the margin zone.

If, however, text is fed in without introduction of a separating character or a line shift before the end of the margin zone, the question "Margin zone ends?" receives a positive answer and another sequence is actuated which is not part of the present invention and will therefore not be explained in detail. This could be, for example, the emission of a warning signal to the operator and the blocking of any further data input.

Figure 3E:
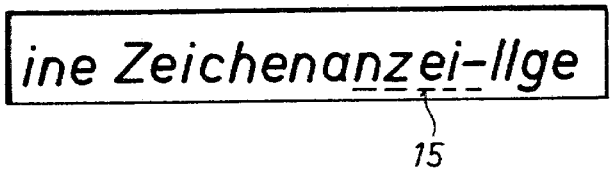

FIG. 3*e* shows a display on the display device as it could occur, for example, when printing out a text stored in the data memory 3. Since in this case it is not necessary to provide an area for marking unoccupied spaces of a margin zone, the area provided for that purpose is utilized for text display. When a text is being read out of the data memory, for example for the purpose of editing, a larger portion of the text can thus be displayed on the display device.

During input of the text via keyboard 5, characters falling into the margin zone 14 have been marked on the display device by markers 15 and these markers 15 are stored in the data memory by associating them with the respective characters once the margin zone reminder has been set. Therefore, readout of the text from the memory again provides a marker 15 for every character falling within the margin zone. Thus, when editing the text, the operator has a means of controlling the occupation of the margin zone.

Conceivable variations of the embodiment described above which would also fall within the scope of the present invention are, for example, those in which margin zone markers 15 are displayed to the right of the entry position 13, but the margin zone 14 is filled with characters continuing to the right to beyond this position; in which the marker 15 of a margin zone position is erased when this position is occupied by a character, i.e. in which the character then has no additional marker; and in which the markers 15 of unoccupied margin zone positions are not erased after a line shift and carriage return but remain in effect between the end of the text of one line and the beginning of the text of the next line to afford an opportunity for the operator, when editing a text obtained from the memory, to have a further means of control.

Additionally, it will be advisable to provide an input possibility for the operator to set the width of a margin zone as desired. For this purpose, either the entry position 13 for the characters to be displayed in the display device can be shifted to the right or left, and thus the margin zone region to the right of the position 13 can be changed, or the control 4 is given an instruction as to how many positions to the right of the entrance position 13 are to be defined and marked as margin zone.

When printing out the text on a record carrier by means of the printing mechanism 8 it may generally not be desirable to mark the characters of the margin zone so that the control 4 will advisably be designed in such a manner that margin zone markers are only displayed on the display device and associated with the characters of the margin zone in the data memory 3.

An exemplary commercially available word processor with associated display device, which could be programmed to operate in accordance with the present invention, is known by the model designation TES 401 electronic typewriter, manufactured by Olivetti & C., S.p.A., Ivrea, Turin, Italy. The programmer would have to redesign the contents of the ROM of the known word processor (corresponding to ROM 2 of FIG. 1) in such a way that the entered characters and spaces of a line are counted and margin zone markers are caused to be displayed in the display device after a predetermined count is reached. If there are not enough display elements in the display device of the known word processor for displaying margin zone markers together with characters it could be necessary to utilize a display device with additional display elements next to the character display elements instead.

It will be understood that the above description of the present invention is susceptible to various modifications, changes and adaptations, and the same are intended to be comprehended within the meaning and range of equivalents of the appended claims.

What is claimed is:

1. In a display device in a character processing machine, which machine operates to provide text in the form of successive lines of characters, with the length of each such line being within a predetermined range defined by a margin zone at the right-hand end of each line, the machine including an input keyboard for the input of character representations and a data memory connected for storing such representations, and the display device being connected to receive such representations from the memory and to display at least the end portion of a line of characters, with each character appearing, in the order of its input to the keyboard, at an entry location of the display and then shifting to the left in the display upon delivery of each subsequent character to the display, the display device having a maximum character display capacity which is less than the number of characters in a single text line of maximum length, the improvement wherein said display device presents a plurality of character display locations equal in number, and corresponding in position, to the spaces of the margin zone at the end of each line of characters, said display device comprises marker display elements at said display locations, and said machine comprises means connected to said display device to actuate said marker display elements for causing margin zone markers to be displayed in said display device at said character display locations.

2. A device as defined in claim 1 wherein said means are arranged for causing each character introduced into the margin zone during input to be displayed in said entry location and the number of margin zone markers displayed to the right of said entry location to be simultaneously reduced by one.

3. A device as defined in claim 1 wherein said means are arranged for causing characters introduced into the margin zone to be displayed in the said entry location and to be provided with respective margin zone markers by shifting the displayed margin zone markers to the right of said entry location by one location to the left.

4. A device as defined in claim 1 wherein said means are arranged for causing characters introduced into the margin zone to be displayed in succession to the right of said entry location.

5. A device as defined in claim 1, 2, 3 or 4 wherein, for texts to be stored in said data memory, said machine comprises means for causing each character falling into the margin zone of a line to be provided with a code representing the margin zone marker which is stored in such a manner that when that character is displayed on said display device from said memory the associated margin zone marker is correspondingly displayed.

6. A device as defined in claim 5 wherein, for each character line which reaches or extends into its associated margin zone, when the text is to be stored in said data memory, said machine comprises means for causing codes for the margin zone markers of the margin zone character display locations which are not occupied by characters to be stored in such a manner that, for the display of the end of a line of the text being read out of said data memory on said display device, the unoccupied margin zone locations are marked.

7. A device as defined in claim 1 wherein said machine includes a printing device for printing each line of characters and comprises means responsive to inputting of a character representing a line shift instruction at a character display location associated with the margin zone, for causing the markers for the margin zone character display locations not occupied by characters to be shifted to the left on said display device beyond said entry location and the characters to be written into the next succeeding line to then be displayed in succession at said entry location.

8. A device as defined in claim 1, said machine includes a printing device for printing each line of characters and comprises means responsive to inputting of a character representing a line shift instruction at a character display location associated with the margin zone for causing the markers of the margin zone character display locations not occupied by characters to be erased on said display device.

9. A device as defined in claim 1 wherein said means operate for causing said margin zone markers to be displayed underneath or above the characters at their associated character display locations.

10. A device as defined in claim 1 wherein said means operate for setting the number of markable margin zone locations to the right of said entry location.

11. A device as defined in claim 10 wherein said means operate to effect such setting by shifting the position of said entry location to the right or left on said display device.

* * * * *